US010370174B1

(12) United States Patent
McIntosh

(10) Patent No.: US 10,370,174 B1
(45) Date of Patent: Aug. 6, 2019

(54) CUP LID DISPENSER ASSEMBLY

(71) Applicant: Robert McIntosh, Las Vegas, NV (US)

(72) Inventor: Robert McIntosh, Las Vegas, NV (US)

( * ) Notice: Subject to any disclaimer, the term of this patent is extended or adjusted under 35 U.S.C. 154(b) by 0 days.

(21) Appl. No.: 16/149,089

(22) Filed: Oct. 1, 2018

(51) Int. Cl.
*B65D 83/00* (2006.01)

(52) U.S. Cl.
CPC ..... *B65D 83/0005* (2013.01)

(58) Field of Classification Search
None
See application file for complete search history.

(56) References Cited

U.S. PATENT DOCUMENTS 1,506,190 A * 8/1924 Marcuse ..... A47K 10/427 221/52
5,328,052 A * 7/1994 Kizilos ..... A47F 1/085 221/231
2005/0194397 A1* 9/2005 Hecht ..... G07F 11/16 221/223
2013/0018506 A1* 1/2013 Cittadino ..... A47K 5/1202 700/240
2013/0146501 A1* 6/2013 Zusmanis ..... B65F 1/06 206/525

* cited by examiner

*Primary Examiner* — Gene O Crawford
*Assistant Examiner* — Ayodeji T Ojofeitimi

(57) ABSTRACT

A cup lid dispenser assembly includes a base that is positionable on a support surface. A tube is coupled to and extends upwardly from the base and a plurality of beverage cup lids is stacked in the tube. The tube has a dispensing opening therein for accessing one of the beverage cup lids. A pair of stops is each coupled to the tube such that the beverage cup lids rest on the stops when the beverage cup lids are positioned in the tube. A dispenser is coupled to the tube and the dispenser is aligned with a respective one of the stops. The dispenser is turned on when a user approaches the tube and engages a respective one of the beverage cup lids thereby urging the respective beverage cup lid to disengage from the stops. Thus, the respective beverage cup lid falls downwardly in the tube and exit the dispensing opening. In this way the dispenser dispenses the respective beverage cup lid for the user.

8 Claims, 5 Drawing Sheets

CUP LID DISPENSER ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to dispenser devices and more particularly pertains to a new dispenser device for PURPOSE.

BRIEF SUMMARY OF THE INVENTION

An embodiment of the disclosure meets the needs presented above by generally comprising a base that is positionable on a support surface. A tube is coupled to and extends upwardly from the base and a plurality of beverage cup lids is stacked in the tube. The tube has a dispensing opening therein for accessing one of the beverage cup lids. A pair of stops is each coupled to the tube such that the beverage cup lids rest on the stops when the beverage cup lids are positioned in the tube. A dispenser is coupled to the tube and the dispenser is aligned with a respective one of the stops. The dispenser is turned on when a user approaches the tube and engages a respective one of the beverage cup lids thereby urging the respective beverage cup lid to disengage from the stops. Thus, the respective beverage cup lid falls downwardly in the tube and exit the dispensing opening. In this way the dispenser dispenses the respective beverage cup lid for the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
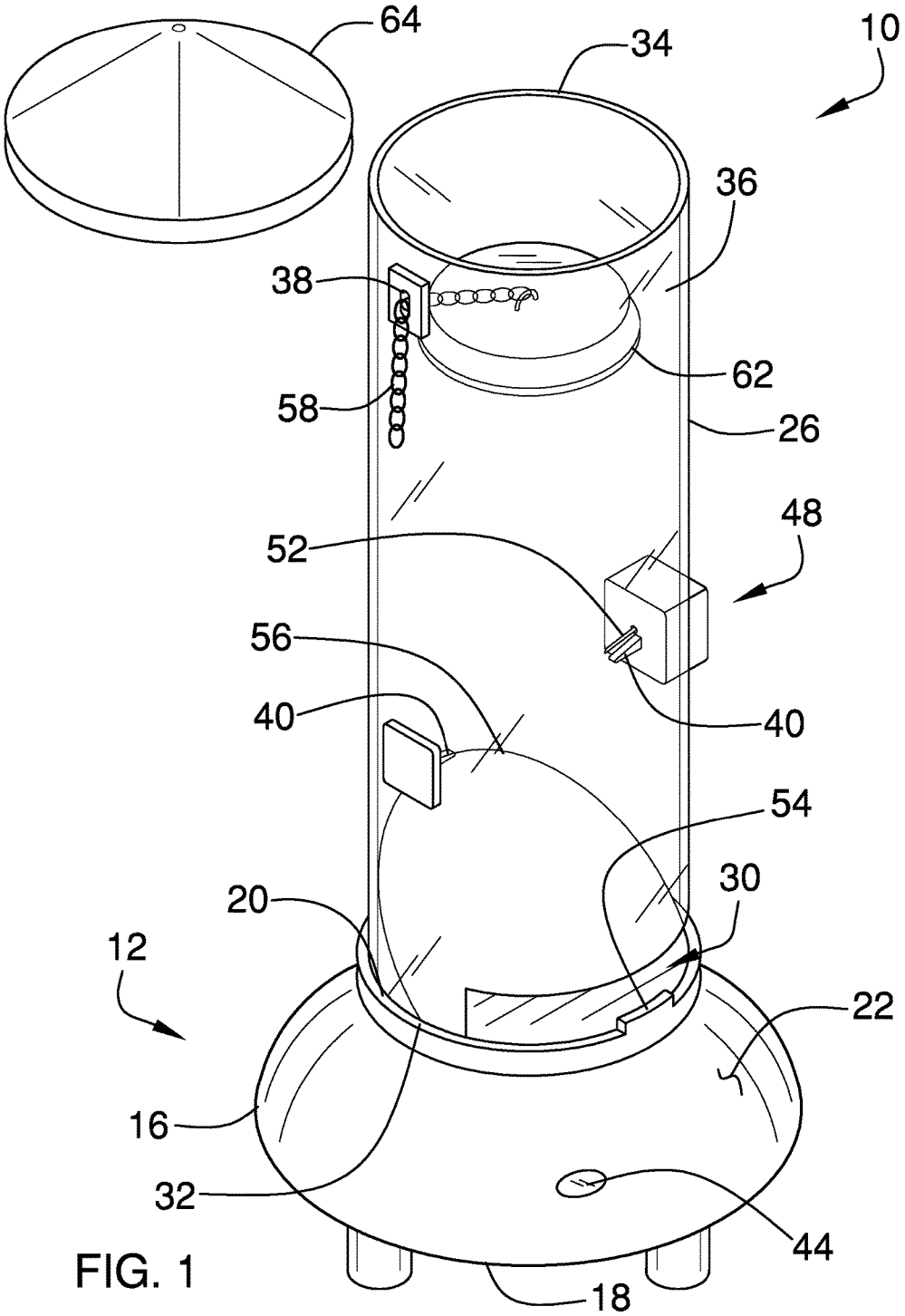
FIG. 1 is a front perspective view of a cup lid dispenser assembly according to an embodiment of the disclosure.
Figure 2:
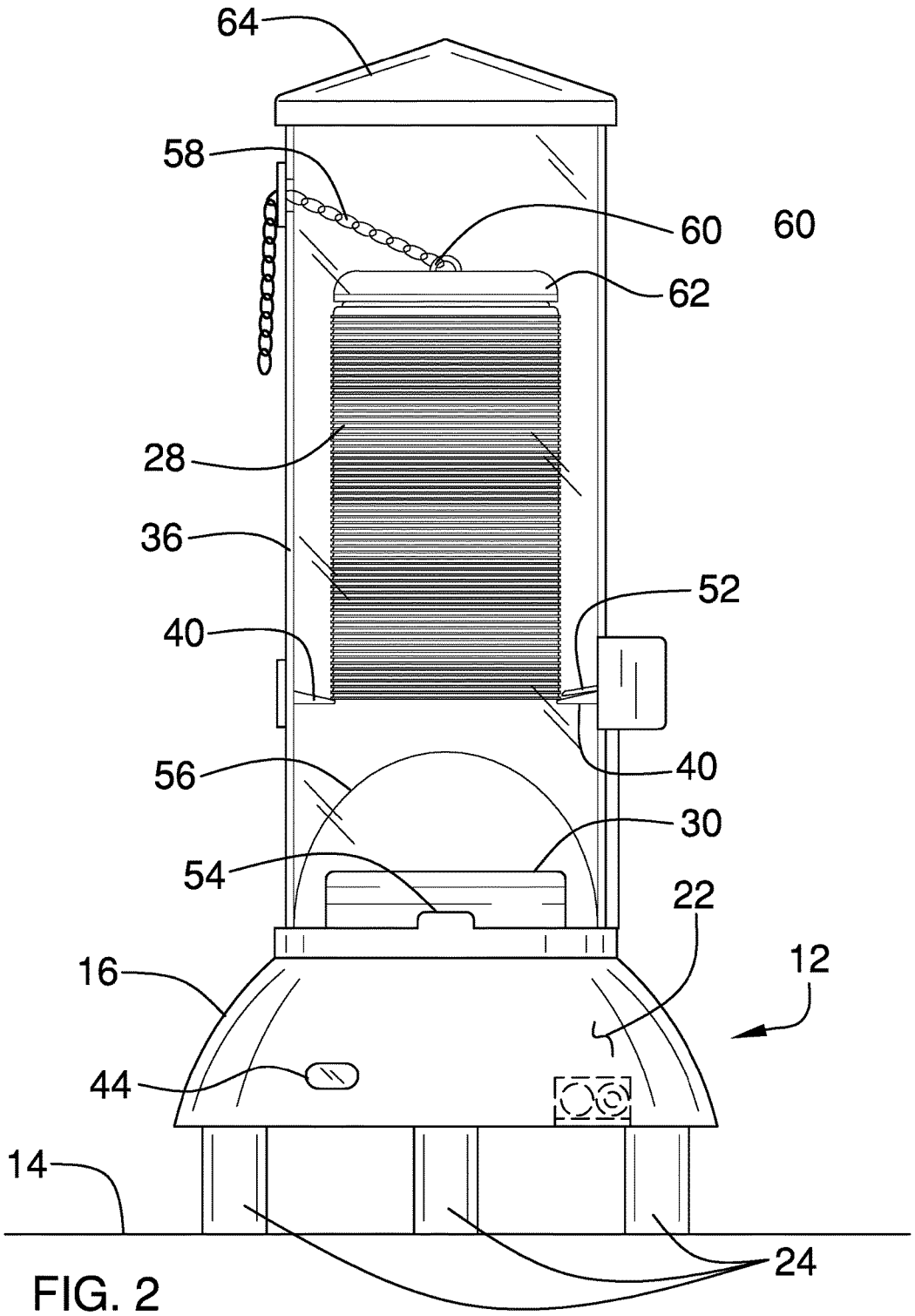
FIG. 2 is a front view of an embodiment of the disclosure.
Figure 3:
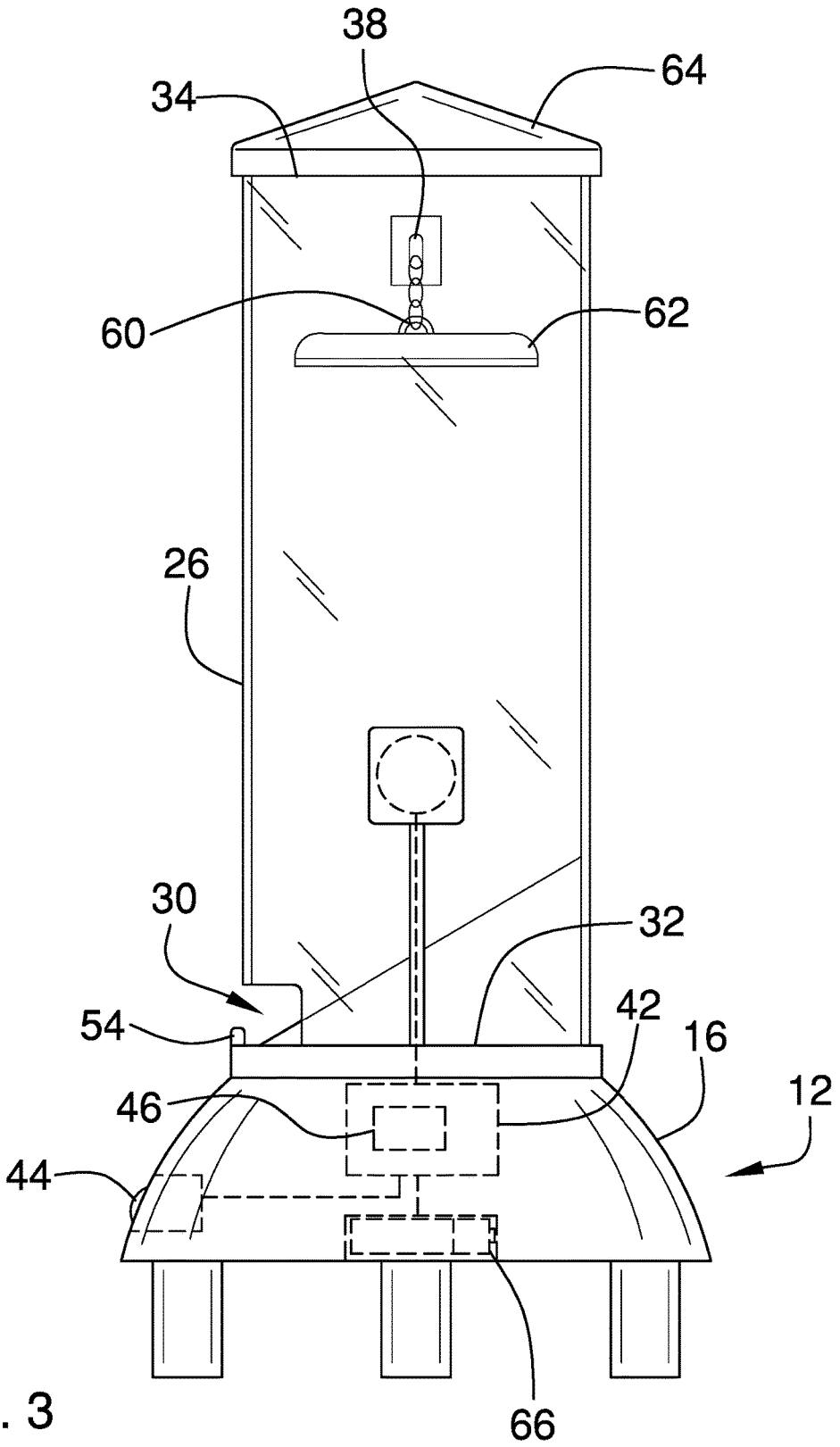
FIG. 3 is a right side phantom view of an embodiment of the disclosure.
Figure 4:
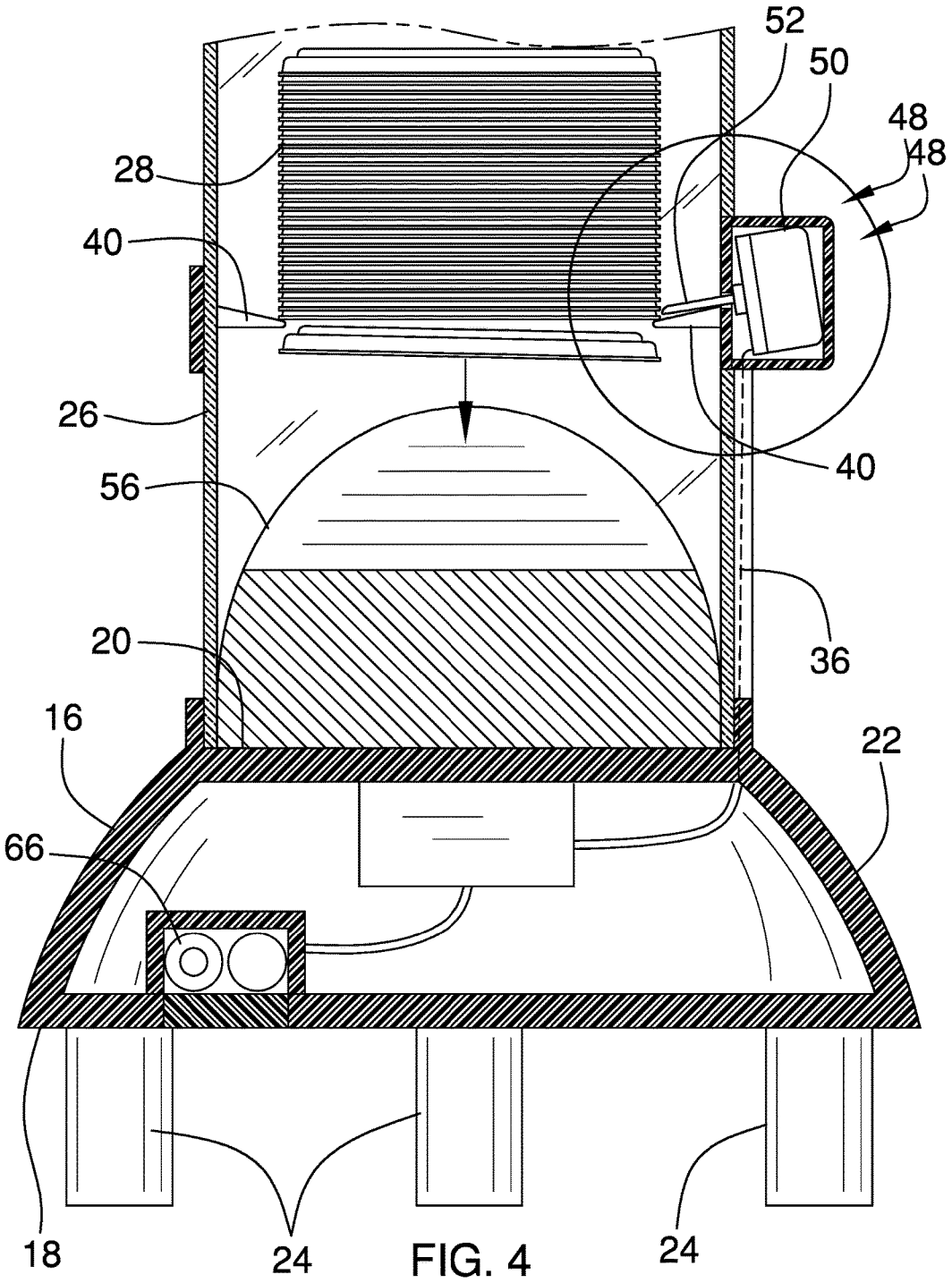
FIG. 4 is a front cut-away view of an embodiment of the disclosure.
Figure 5:
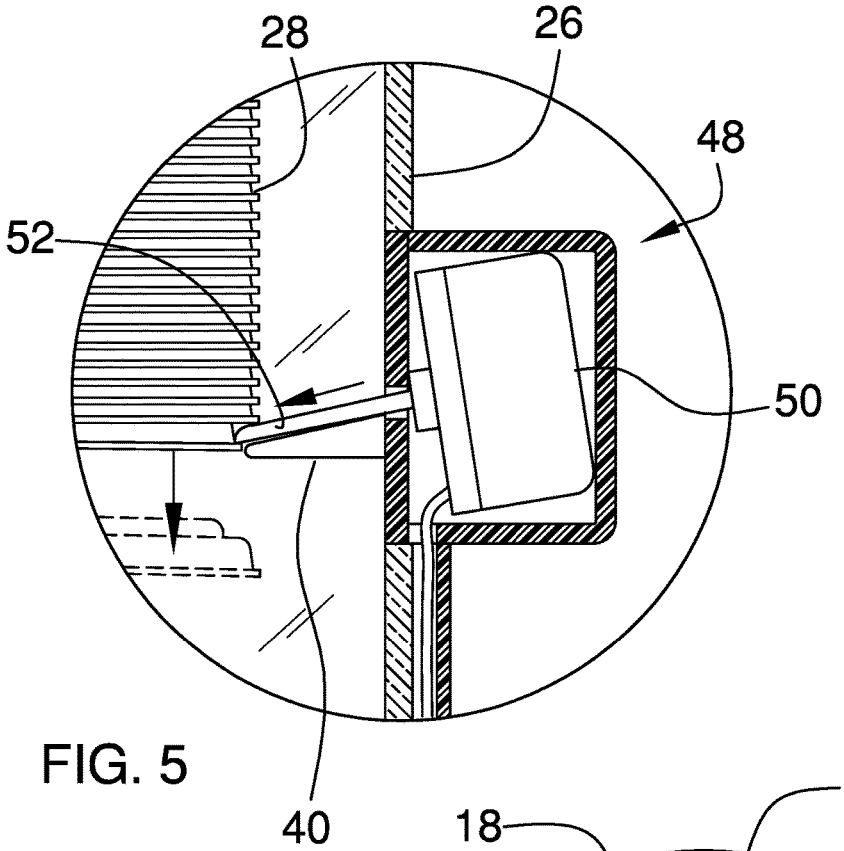
FIG. 5 is a detail view taken from circle 5 of FIG. 4 of an embodiment of the disclosure.
Figure 6:
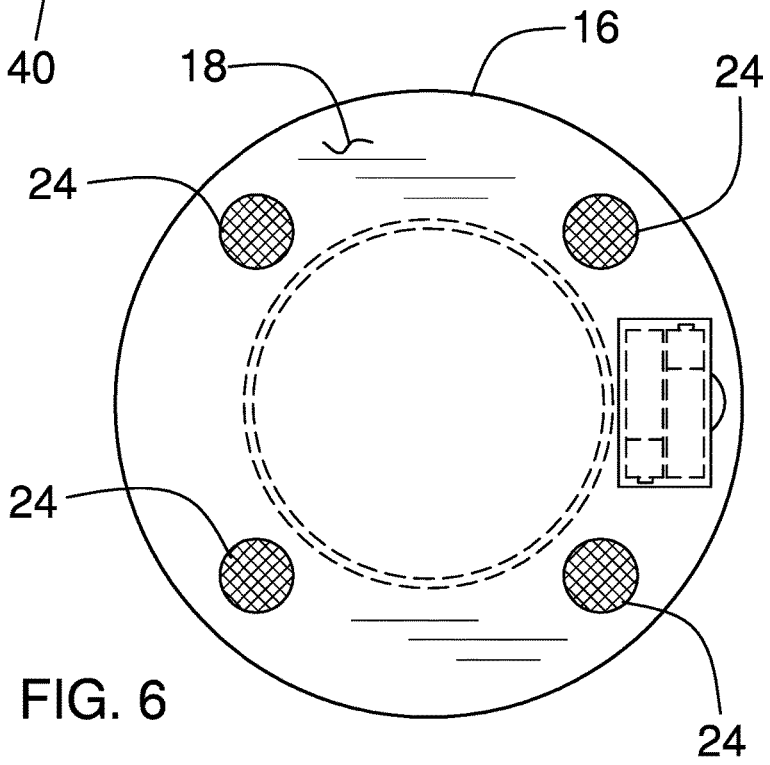
FIG. 6 is a bottom phantom view of an embodiment of the disclosure.

With reference now to the drawings, and in particular to FIGS. 1 through 6 thereof, a new dispenser device embodying the principles and concepts of an embodiment of the disclosure and generally designated by the reference numeral 10 will be described.

As best illustrated in FIGS. 1 through 6, the cup lid dispenser assembly 10 generally comprises a base 12 that is positionable on a support surface 14 such as a table in a restaurant or other location involving the sale of fountain beverages. The base 12 comprises a dome 16 that has a lower surface 18, an upper surface 20 and an outer surface 22 extending therebetween. The outer surface 22 curves inwardly between the lower 18 and upper 20 surfaces such that the lower surface 18 has a greater diameter than the upper surface 20. A plurality of legs 24 is each coupled to and extends downwardly from the lower surface 18 of the dome 16, and each of the legs 24 abuts the support surface 14 to support the dome 16 above the support surface 14.

A tube 26 is coupled to and extends upwardly from the base 12 and a plurality of beverage cup lids 28 is stacked in the tube 26. The beverage cup lids 28 may be fountain drink lids of any conventional design such as are commonly provided in restaurants that serve fountain drinks. The tube 26 is comprised of a translucent material such that the beverage cup lids 28 are visible in the tube 26. Additionally, the tube 26 has a dispensing opening 30 therein for accessing one of the beverage cup lids 28.

The tube 26 has a bottom end 32, a top end 34 and an outer wall 36 extending therebetween, and the bottom end 32 is coupled to the upper surface 20 of the dome 16. The dispensing opening 30 extends through the outer wall 36 and the dispensing opening 30 extends from the bottom end 32 upwardly toward the top end 34. The outer wall 36 has a chain opening 38 extending therethrough and the chain opening 38 is positioned closer to the top end 34 than the bottom end 32. The tube 26 may have a height ranging between approximately 18.0 inches and 24.0 inches.

A pair of stops 40 is each coupled to the tube 26 and each of the stops 40 is positioned within the tube 26 and extends inwardly toward a center of the tube 26. Moreover, the beverage cup lids 28 rest on the stops 40 when the beverage cup lids 28 are positioned in the tube 26. Each of the stops 40 is spaced upwardly from the dispensing opening 30 in the tube 26. A control circuit 42 is coupled to the base 12 and a motion detector 44 is coupled to the base 12 for detecting motion within a trigger distance of the base 12. In this way the motion detector 44 can detect a user approaching the base 12. The trigger distance may be a distance ranging between approximately 5.0 feet and 10.0 feet and the motion detector 44 may be an electronic motion detector 44 of any conventional design.

The motion detector 44 is electrically coupled to the control circuit 42 and the control circuit 42 receives a dispense input when the motion detector 44 detects motion within the trigger distance. The control circuit 42 includes an electronic timer 46 and the electronic timer 46 counts down a pause duration of time when the control circuit 42 receives the dispense input. In this way the control circuit 42 is inhibited from responding to a subsequent dispense input until the pause duration of time expires. The pause duration of time may range between approximately 4.0 seconds and 6.0 seconds.

A dispenser 48 is coupled to the tube 26 and the dispenser 48 is electrically coupled to the control circuit 42. The dispenser 48 is aligned with a respective one of the stops 40 and the dispenser 48 is turned on when the control circuit 42 receives the dispense input. Moreover, the dispenser 48 engages a respective one of the beverage cup lids 28 when the dispenser 48 is turned on thereby urging the respective beverage cup lid 28 to disengage from the stops 40. In this way the respective beverage cup lid 28 falls downwardly in the tube 26 and exits the dispensing opening 30 to dispense the respective beverage cup lid 28 for the user.

The dispenser 48 comprises a motor 50 that is coupled to the outer wall 36 of the tube 26. The motor 50 is electrically coupled to the control circuit 42 and the motor 50 is turned on when the control circuit 42 receives the dispense input. The motor 50 may be an electric motor 50 or the like and the motor 50 may be positioned within a motor 50 housing that is coupled to the outer wall 36 of the tube 26. A finger 52 is movably coupled to the motor 50 and extends inwardly through the outer wall 36 of the tube 26. The finger 52 is aligned with a respective one of the stops 40 and the finger 52 is urged inwardly on the tube 26 when the motor 50 is turned on to urge the respective beverage cup lid 28 off of the stops 40.

A catch 54 is coupled to and extends upwardly from the upper surface 20 of the dome 16. The catch 54 is aligned with the dispensing opening 30 for stopping the respective beverage cup lid 28 from passing through the dispensing opening 30. A ramp 56 is positioned within the tube 26 and the ramp 56 is positioned at a downward angle with respect to the upper surface 20 of the dome 16. Thus, the respective beverage cup lid 28 slides downwardly on the ramp 56 and abuts the catch 54 wherein the respective beverage cup lid 28 is positioned to be retrieved by the user.

A chain 58 extends through the chain opening 38 in the tube 26 and the chain 58 has a first end 60 that is positioned inside the tube 26. A weight 62 is coupled to the first end 60 of the chain 58 such that the weight 62 rests on the beverage cup lids 28 in the tube 26 for urging the stack of beverage cup lids 28 downwardly onto the stops 40. The weight 62 may have a disk shape that corresponds to a shape of the beverage cup lids 28. Additionally, the weight 62 may have a weight ranging between approximately 2.0 ounces and 4.0 ounces. A lid 64 is removably positioned on the top end 34 of the tube 26 for closing the top end 34 and a power supply 66 is positioned in the dome 16. The power supply 66 is electrically coupled to the control circuit 42 and the power supply 66 comprises at least one battery.

In use, the beverage cup lids 28 are stacked in the tube 26 and the lid 64 is positioned on the tube 26 to close the tube 26. The control circuit 42 receives the dispense input when the motion detector 44 detects that the user has moved within the trigger distance of the tube 26. Thus, the motor 50 is turned on and the finger 52 urges the respective beverage cup lid 28 to disengage from the stops 40 and fall downwardly in the tube 26. The respective beverage cup lid 28 lands on the ramp 56 and slides downwardly along the ramp 56 until the respective beverage cup lid 28 abuts the catch 54. Thus, the respective beverage cup lid 28 is positioned for retrieval by the user. In this way the beverage cup lids 28 can be dispensed without being handled by multiple people thereby reducing the transfer of bacteria on the beverage cup lids 28 between the multiple people.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cup lid dispenser assembly being configured to individually dispense beverage cup lids for reducing the spread of bacteria on the beverage cup lids, said assembly comprising:

a base being positionable on a support surface;

a tube being coupled to and extending upwardly from said base, said tube having a plurality of beverage cup lids stacked therein, said tube having a dispensing opening therein for accessing one of the beverage cup lids;

a pair of stops, each of said stops being coupled to said tube such that the beverage cup lids rest on said stops when the beverage cup lids are positioned in said tube;

a dispenser being coupled to said tube, said dispenser being aligned with a respective one of said stops, said dispenser being turned on when a user approaches said tube and engaging a respective one of the beverage cup lids thereby urging the respective beverage cup lid to disengage from said stops thereby facilitating the respective beverage cup lid to fall downwardly in said tube and exit said dispensing opening wherein said dispenser is configured to dispense the respective beverage cup lid for the user;

a control circuit being coupled to said base, said control circuit includes an electronic timer;

a motion detector being coupled to said base for detecting motion within a trigger distance of said base wherein said motion detector is configured to detect a user approaching said base, said motion detector being electrically coupled to said control circuit, said control circuit receiving a dispense input when said motion detector detects motion within said trigger distance, said electronic timer counting down a pause duration of time when said control circuit receives said dispense input thereby inhibiting said control circuit from responding to a subsequent dispense input until said pause duration of time expires; and said dispenser comprising a motor being coupled to said outer wall of said tube, said motor being electrically coupled to said control circuit, said motor being turned on when said control circuit receives said dispense input, and a finger being movably coupled to said motor and extending through said outer wall of said tube, said finger being aligned with a respective one of said stops, said finger being urged inwardly on said tube when said motor is turned on to urge the respective beverage cup lid off of said stops.

2. The assembly according to claim 1, further comprising a power supply being positioned in said dome, said power supply being electrically coupled to said control circuit, said power supply comprising at least one battery.

3. The assembly according to claim 1, wherein said base comprises:

a dome having a lower surface, an upper surface and an outer surface extending therebetween, said outer surface curving inwardly between said lower and upper surfaces such that said lower surface has a greater diameter than said upper surface; and a plurality of legs, each of said legs being coupled to and extending downwardly from said lower surface of said dome, each of said legs abutting the support surface to support said dome above the support surface.

4. The assembly according to claim 3, wherein:

said tube has a bottom end, a top end and an outer wall extending therebetween, said bottom end being coupled to said upper surface of said dome;

said dispensing opening extends through said outer wall, said dispensing opening extending from said bottom end upwardly toward said top end; and said outer wall has a chain opening extending therethrough, said chain opening being positioned closer to said top end than said bottom end.

5. The assembly according to claim 4, further comprising a catch being coupled to and extending upwardly from said upper surface of said dome, said catch being aligned with said dispensing opening for stopping the respective beverage cup lid from passing through said dispensing opening.

6. The assembly according to claim 5, further comprising a ramp being positioned within said tube, said ramp being positioned at a downward angle with respect to said upper surface of said dome such that the respective beverage lid slides downwardly on said ramp and abuts said catch wherein the respective beverage lid is positioned to be retrieved by the user.

7. A cup lid dispenser assembly being configured to individually dispense beverage cup lids for reducing the spread of bacteria on the beverage cup lids, said assembly comprising:

a base being positionable on a support surface, said base comprising a dome having a lower surface, an upper surface and an outer surface extending therebetween, said outer surface curving inwardly between said lower and upper surfaces such that said lower surface has a greater diameter than said upper surface, and a plurality of legs, each of said legs being coupled to and extending downwardly from said lower surface of said dome, each of said legs abutting the support surface to support said dome above the support surface;

a tube being coupled to and extending upwardly from said base, said tube having a plurality of beverage cup lids stacked therein, said tube having a dispensing opening therein for accessing one of the beverage cup lids, said tube having a bottom end, a top end and an outer wall extending therebetween, said bottom end being coupled to said upper surface of said dome, said dispensing opening extending through said outer wall, said dispensing opening extending from said bottom end upwardly toward said top end, said outer wall having a chain opening extending therethrough, said chain opening being positioned closer to said top end than said bottom end;

a pair of stops, each of said stops being coupled to said tube such that the beverage cup lids rest on said stops when the beverage cup lids are positioned in said tube;

a dispenser being coupled to said tube, said dispenser being aligned with a respective one of said stops, said dispenser being turned on when a user approaches said tube and engaging a respective one of the beverage cup lids thereby urging the respective beverage cup lid to disengage from said stops thereby facilitating the respective beverage cup lid to fall downwardly in said tube and exit said dispensing opening wherein said dispenser is configured to dispense the respective beverage cup lid for the user;

a chain extending through said chain opening in said tube, said chain having a first end being positioned inside said tube; and a weight being coupled to said first end of said chain such that said weight rests on the beverage cup lids in said tube for urging the stack of beverage cup lids downwardly onto said stops.

8. A cup lid dispenser assembly being configured to individually dispense beverage cup lids for reducing the spread of bacteria on the beverage cup lids, said assembly comprising:

a base being positionable on a support surface, said base comprising:

a dome having a lower surface, an upper surface and an outer surface extending therebetween, said outer surface curving inwardly between said lower and upper surfaces such that said lower surface has a greater diameter than said upper surface; and a plurality of legs, each of said legs being coupled to and extending downwardly from said lower surface of said dome, each of said legs abutting the support surface to support said dome above the support surface;

a tube being coupled to and extending upwardly from said base, said tube having a plurality of beverage cup lids stacked therein, said tube being comprised of a translucent material such that the beverage cup lids are visible in said tube, said tube having a dispensing opening therein for accessing one of the beverage cup lids, said tube having a bottom end, a top end and an outer wall extending therebetween, said bottom end being coupled to said upper surface of said dome, said dispensing opening extending through said outer wall, said dispensing opening extending from said bottom end upwardly toward said top end, said outer wall having a chain opening extending therethrough, said chain opening being positioned closer to said top end than said bottom end;

a pair of stops, each of said stops being coupled to said tube, each of said stops being positioned within said tube and extending inwardly toward a center of said tube such that the beverage cup lids rest on said stops when the beverage cup lids are positioned in said tube, each of said stops being spaced upwardly from said dispensing opening in said tube;

a control circuit being coupled to said base;

a motion detector being coupled to said base for detecting motion within a trigger distance of said base wherein said motion detector is configured to detect a user approaching said base, said motion detector being electrically coupled to said control circuit, said control circuit receiving a dispense input when said motion detector detects motion within said trigger distance, said control circuit including an electronic timer, said electronic timer counting down a pause duration of time when said control circuit receives said dispense input thereby inhibiting said control circuit from responding to a subsequent dispense input until said pause duration of time expires;

a dispenser being coupled to said tube, said dispenser being electrically coupled to said control circuit, said dispenser being aligned with a respective one of said stops, said dispenser being turned on when said control circuit receives said dispense input, said dispenser engaging a respective one of the beverage cup lids when said dispenser is turned on thereby urging the respective beverage cup lid to disengage from said stops thereby facilitating the respective beverage cup lid to fall downwardly in said tube and exit said dispensing opening wherein said dispenser is configured to dispense the respective beverage cup lid for the user, said dispenser comprising:

a motor being coupled to said outer wall of said tube, said motor being electrically coupled to said control circuit, said motor being turned on when said control circuit receives said dispense input; and a finger being movably coupled to said motor and extending through said outer wall of said tube, said finger being aligned with a respective one of said stops, said finger being urged inwardly on said tube when said motor is turned on to urge the respective beverage cup lid off of said stops;

a catch being coupled to and extending upwardly from said upper surface of said dome, said catch being aligned with said dispensing opening for stopping the respective beverage cup lid from passing through said dispensing opening;

a ramp being positioned within said tube, said ramp being positioned at a downward angle with respect to said upper surface of said dome such that the respective beverage lid slides downwardly on said ramp and abuts said catch wherein the respective beverage lid is positioned to be retrieved by the user;

a chain extending through said chain opening in said tube, said chain having a first end being positioned inside said tube;

a weight being coupled to said first end of said chain such that said weight rests on the beverage cup lids in said tube for urging the stack of beverage cup lids downwardly onto said stops;

a lid being removably positioned on said top end of said tube for closing said top end; and a power supply being positioned in said dome, said power supply being electrically coupled to said control circuit, said power supply comprising at least one battery.

* * * * *